US005165559A

United States Patent [19]

Kusz

[11] Patent Number: 5,165,559

[45] Date of Patent: Nov. 24, 1992

[54] CHILD RESISTANT CLOSURE AND PACKAGE

[75] Inventor: Maximillian Kusz, Waterville, Ohio

[73] Assignee: Owens-Illinois Closure Inc., Toledo, Ohio

[21] Appl. No.: 628,797

[22] Filed: Dec. 17, 1990

Related U.S. Application Data

[63] Continuation-in-part of Ser. No. 473,565, Feb. 1, 1990, abandoned.

[51] Int. Cl.[5] ..... B65D 55/02

[52] U.S. Cl. ..... 215/216; 215/330; 215/342

[58] Field of Search ..... 215/216, 218, 219, 220, 215/221, 330, 341, 342, 346, 217, 329

[56] References Cited

U.S. PATENT DOCUMENTS

| | | | |
|---|---|---|---|
| 2,312,513 | 3/1943 | Wilson | 215/329 |
| 2,684,168 | 7/1954 | McGinnis et al. | 215/330 |
| 3,123,205 | 3/1964 | Ehrsam | 215/341 X |
| 3,565,274 | 2/1971 | Davidson | 215/341 X |
| 3,741,423 | 6/1973 | Acton et al. | 215/346 X |
| 3,826,395 | 7/1974 | Montgomery | 215/221 |
| 3,888,373 | 6/1975 | Gach et al. | 215/214 |
| 3,971,487 | 7/1976 | Montgomery | 215/216 |
| 3,986,626 | 10/1976 | Montgomery | 215/216 |
| 3,989,152 | 11/1976 | Julian | 215/216 |
| 4,210,251 | 7/1980 | Grussen | 215/329 |
| 4,331,247 | 5/1982 | Mumford | 215/216 |
| 4,341,318 | 7/1982 | Smalley | 215/225 |
| 4,371,091 | 2/1983 | Gelina | 220/288 |
| 4,557,394 | 12/1985 | Luker | 215/317 |
| 4,572,385 | 2/1986 | Luker | 215/216 |
| 4,828,130 | 5/1989 | Hofmann | 215/317 |
| 4,865,209 | 9/1989 | Bush | 215/216 |
| 4,946,055 | 8/1990 | Towns et al. | 215/254 |

FOREIGN PATENT DOCUMENTS

| | | | |
|---|---|---|---|
| 2204979 | 8/1973 | Fed. Rep. of Germany | 215/341 |
| 469448 | 3/1952 | Italy | 215/342 |
| 566237 | 9/1975 | Switzerland | 215/341 |

*Primary Examiner*—Stephen Marcus
*Assistant Examiner*—Stephen Cronin

[57] ABSTRACT

A child resistant closure adapted to be used with a container to provide a child resistant package comprising a closure having a base wall and a peripheral skirt with internal threads adapted to engage complementary threads on the container. The closure is provided with a plurality of circumferentially spaced flexible fins which frictionally engage the apex only of an annular bead on the container to provide resistance to closure back off in order to resist unthreading of the closure from the container. The closure is to be provided with a tab which is engageable with a projection on the container to prevent unthreading of the closure except when the tab is depressed. In another form, a cylindrical surface on the skirt frictionally engages solely the apex of the annular bead on the container. The cylindrical surface may be a continuous surface or a series of closely spaced annular serrations and alternating fine grooves. The closure may also be used without a tab to provide a secondary seal on a conventional threaded closure.

6 Claims, 7 Drawing Sheets

CHILD RESISTANT CLOSURE AND PACKAGE

This application is a continuation-in-part of prior application Ser. No. 07/473,565 filed Feb. 1, 1990 now abandoned.

This invention relates to child resistant closures and packages.

BACKGROUND AND SUMMARY OF THE INVENTION

In the prior art, it has been common to provide child resistant closures which include as a feature some construction for preventing or resisting rotation between the closure and at the same time maintaining a seal to prevent leakage of contents during the initial unthreading of the closure from the container. Thus, U.S. Pat. No. 3,971,487 discloses the concept of an internal annular bead on the closure engaging a complementary bead on the finish of the container so that when the closure is initially rotated, the base of the closure is maintained in sealing contact with the finish even though the threads have begun to lose contact. In such a construction, the use of a solid closure bead in connection with the solid bead on the container has a problem requiring of high torque for application and removal. In addition, due to normal dimensional tolerances in an axial direction, the seal is not maintained when the closure is fully applied. Such closures utilize a depressable tab that engages a projection on a container so that when the tab is depressed, the closure can be rotated to remove the closure from the container.

Certain containers especially those for anti-freeze are sealed with closure that have an aluminum foil disk induction sealed over the mouth of the finish During the process of activating the induction seal, the closure may become loose and is usually retightened before the containers are shipped while the induction seal prevents leakage it is undesirable to have loose closures, especially child resistant closures.

Further, one piece child resistant closures having a tab on the closure and an abutment on the finish usually have a space between them such that the closure can be moved several degrees of rotation in the unscrewing direction before the tab contacts the abutment. When this occurs, the closure is free to move vertically with respect to the finish because the top of the closure threads are not in contact with the bottom of the container threads Among the objectives of the present invention are to provide a child resistant closure which will maintain the oriented position with respect to the container when the closure is applied; which will resist inadvertent rotation as by vibration and thereby maintain a seal except when sufficient force is supplied to rotate the closure; which prevents the closure from moving out of sealing position when the closure is being unthreaded until the threads elevate the closure out of sealing position; which functions over a greater range of tolerances; which requires minimal torque to apply; which does not require excessive torque to remove; which closure can be utilized in connection with conventional containers having a projection and incorporating a tab with the closure for engaging the projection upon rotation of the closure beyond a certain point unless the tab is depressed; which closure can also be utilized on a container which does not require a tab; which will effectively deter and resist rotation without the necessity of close tolerances between the closure and the container; and which provides a secondary seal at the apex of an annular bead on the container; and which can be used without a tab as a conventional threaded closure having a secondary seal.

In accordance with the invention, the child resistant closure is adapted to be used with a container to provide a child resistant package and comprises a closure having a base wall and a peripheral skirt with internal threads adapted to engage complementary threads on the container. The closure is provided with a plurality of circumferentially spaced flexible fins which frictionally engage the apex only of an annular bead on the container to provide resistance to closure back off in order to resist unthreading of the closure from the container. The closure is provided with a tab which is engageable with a projection on the container to prevent unthreading of the closure except when the tab is depressed. In another form, a cylindrical surface on the skirt frictionally engages solely the apex of the annular bead on the container. The cylindrical surface may be a continuous surface or a series of closely spaced annular serrations and alternating fine grooves. The closure may also be used without a tab to provide a secondary seal on a conventional threaded closure.

DESCRIPTION

Figure 1:
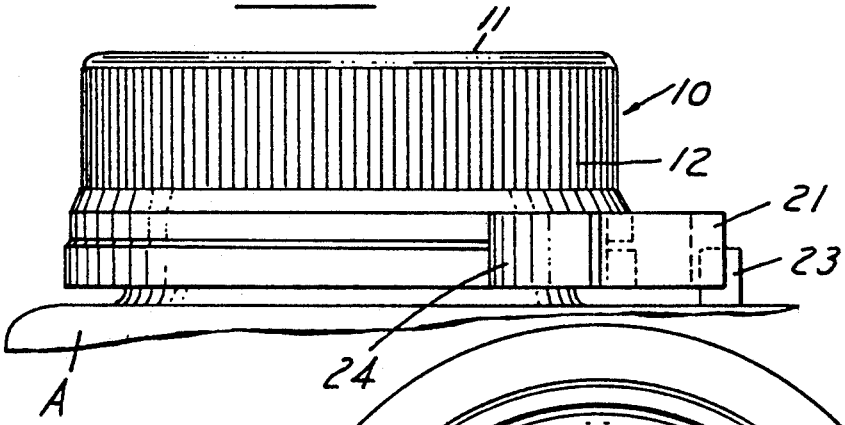
FIG. 1 is a fragmentary elevational view of a child resistant closure and container embodying the invention.
Figure 2:
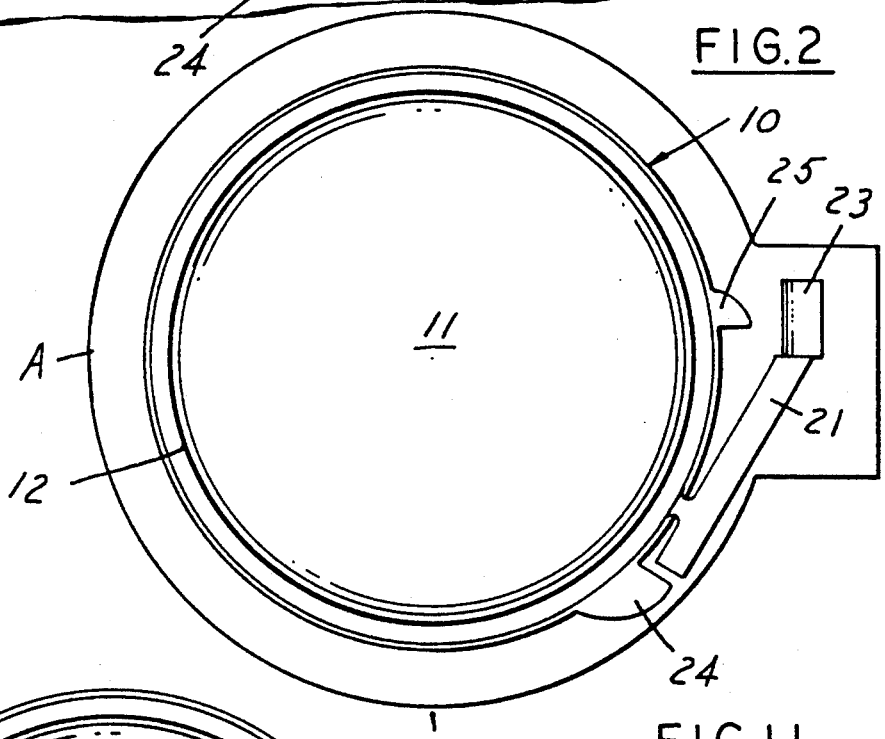
FIG. 2 is a plan view of the same.
Figure 3:
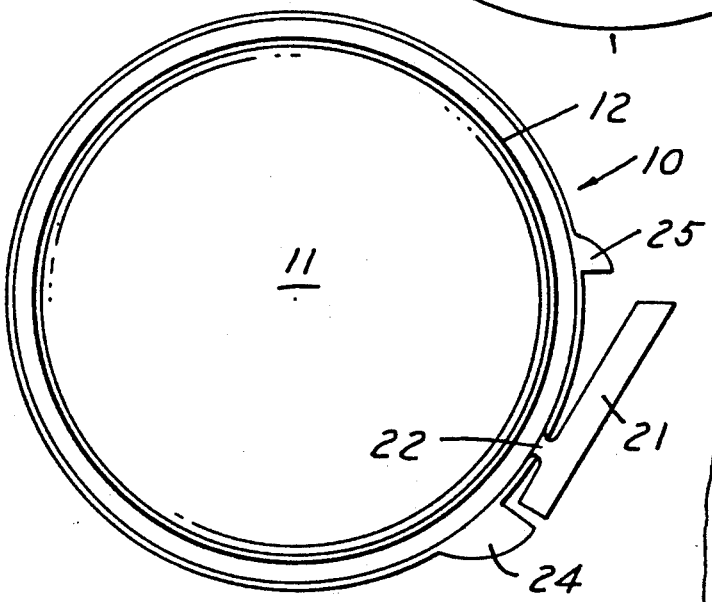
FIG. 3 is a plan view of the closure.

Referring to FIGS. 1–7, the child resistant closure 10 is shown as applied to a glass or plastic container C and is made of plastic material such as polypropylene. Closure 10 includes a base wall 11 and a peripheral wall or skirt 12 having internal threads 13 adapted to engage complementary threads 13*a* on the container A. The closure 10 includes a lower skirt portion 14 that has a greater diameter then the remainder of the skirt 12 and is formed with the plurality of vertically extending flexible fins 15 joined to the portion 14 by an integral end portion 16. The fins 15 extend radially inwardly and preferably form an acute angle with the portion 14 in a direction opposite to that in which the closure is rotated to thread the closure on the container. The fins 15 are preferably joined by a portion 17 between the upper skirt portion 12 and the lower skirt portion 14 and are preferably rectangular in form. The free edges or ends of the fins 15 define an apex 18 that engages an annular bead 20 in the finish of the container C. The thickness of and or the number of fins can be varied depending upon the desired amount of frictional contact desired between closure and container finish.

A rectangular tab 21 is connected to the lower portion of skirt 12 intermediate its ends by an integral hinge 22 nearest one end which is the leading end when the closure is threaded on the container. The tab 21 extends outwardly and generally circumferentially and is positioned a sufficient distance from the skirt such that the outer or trailing end of tab 21 will contact an abutment or projection 23 on the finish of the container A which extends generally axially from the container into the path of the outer end. The abutment 23 on the finish is positioned such that its inner surface is approximately the same distance from the center line of a radial projection 24 that extends radially from the skirt 23 on the closure skirt. This projection 24 is positioned immediately after the tab 21 in a clockwise direction as viewed in FIG. 2. Unscrewing the closure 10 without depressing the tab 21 inward of the abutment 23 will cause the tab 21 to be wedged between the projection 24 on the closure skirt 12 and the abutment 23. The closure 10 further includes a second radial abutment 25 adjacent the trailing edge of tab 21 which functions to prevent the tab 21 of the closure 10 to interlock with another closure 10 when the closures are handled and stored in bulk such that they could not be readily sorted and oriented by a sorting machine for application to containers.

The fins 15 are generally parallel to the vertical axis of the closure, as molded. When the closure is applied the fins 15 will flex or bend outward toward the interior of the closure skirt. When the closure is fully applied and tightened, the fins will remain in frictional contact only with the apex of bead 20 on the container A. This frictional contact will prevent or significantly reduce the loosening, or back off of the closure from the finish. A further benefit is the anticipated result of rotating the closure some number of degrees in the unscrewing direction as in rotating a one piece child resistant closure to the point where a tab 21 on the closure contacts abutment 23 on the finish. Because there is frictional contact between the fins 15 and the bead 20 on the closure, the closure and its sealing mechanism will remain in vertical contact with the finish. Thus, the closure will not move vertically out of sealing engagement with the finish until either an external force is applied to the closure to pull it up, or until further counterclockwise rotation causes engagement between the underside of the closure threads 13 with the upper side of the container threads 13*a* to drive the closure upwards.

The closure is applied by screwing it on the finish in the normal clockwise direction. As the closure is being applied the tab 21 cams past the abutment 23 because the inner end of the tab 21 is radially closer to the skirt 12 of the closure 10 than the outer end that contacts the abutment 23 on the finish. When the closure is unscrewed, the outer end of the tab 21 contacts the abutment 23 on the finish and stops rotation of the closure. Extreme force on the closure will cause the inner end of the tab 21 to come into contact with the projection 24 and prevent further rotation of the closure in the a counterclockwise or unthreading direction. To remove the closure, one must manually depress the tab 21 inwardly toward the skirt of the closure while turning the closure until the tab is rotated past the abutment. When this occurs the closure may be unscrewed from the finish without continuously depressing the tab 21.

One skilled in the art of package design of closures and containers is aware of the normal tolerances encountered in the manufacture of these parts as in the aforementioned U.S. Pat. No. 3,971,487. The tolerances are such that it is not realistic to expect the tab to line up in abutting position when the closure is in its fully applied position. Rather the tab will be some number of degrees of rotation past the abutment. The closure may now be rotated from its fully applied position to the point where the front of the tab contacts the abutment on the container. By heating the closure in the induction seal activating process, by vibration during transport, or by other means the closure can "back off" to this position. To deter this from happening by the described or other means a series of fins extend downwardly from the interior of the closure and contact a bead protruding radially from the finish. These fins could also extend either radially from the skirt of the closure or extend at some angle from the skirt.

When the closure shown is applied to the finish such that the fins 15 ride over the bead 20. In the preferred embodiment, the fins 15 extend at an angle to the radius and will flex outwardly toward the interior wall of the closure when the closure is fully applied.

The force exerted upon the bead 20 by the fins 15 will eliminate or resist closure "back off". Further, rotation of the closure in the unscrewing direction will cause the closure to stay in the same vertical alignment with the finish until the closure is rotated a sufficient distance to have the lower side of the closure threads contact the upper side of the container threads and begin driving the closure upward, or until a sufficient external force is applied to the closure to pull it upward away from the containers finish. The closure will remain in the same relative vertical position because of the frictional contact between the fins and closure bead.

An added advantage is the ease of application of this closure upon the finish. Other tamper indicating closures having a solid bead on both the closure and container and anti-backoff closures having solid beads, such as in the aforementioned U.S. Pat. No. 3,971,487, have historically had problems with application torque. The closure utilizing the flexible fins of the present invention require much less application torque than solid bead closures over the range of tolerances of the containers and closures produced under commercial conditions.

Figure 14:
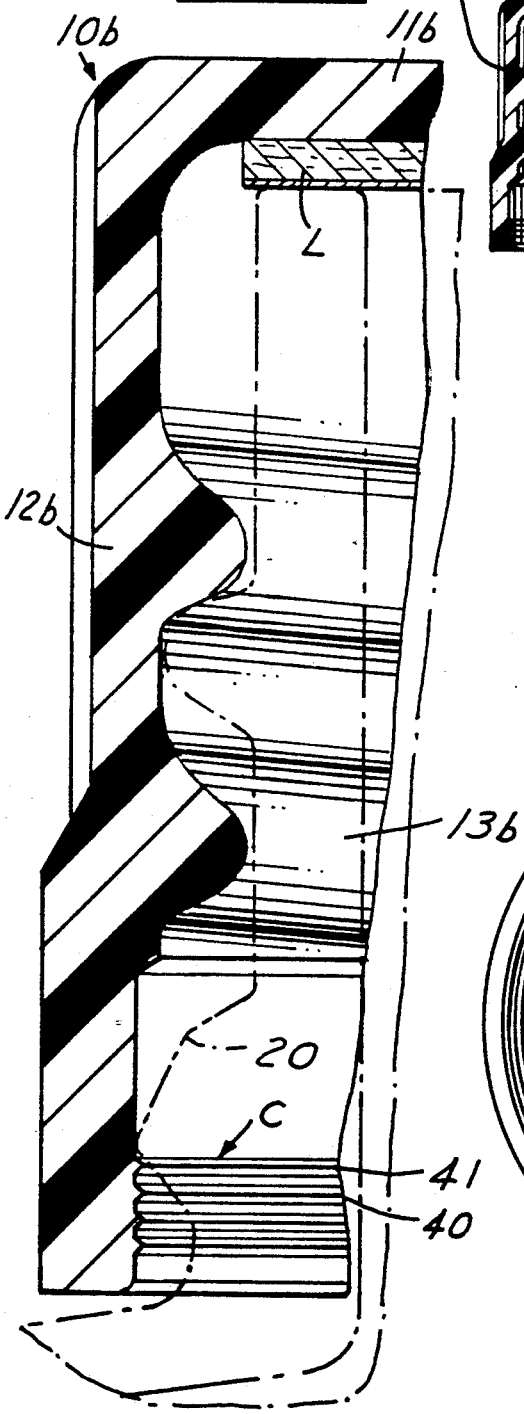
FIG. 14 is a fragmentary sectional view on a greatly enlarged scale of a portion of the closure.
Figure 12:
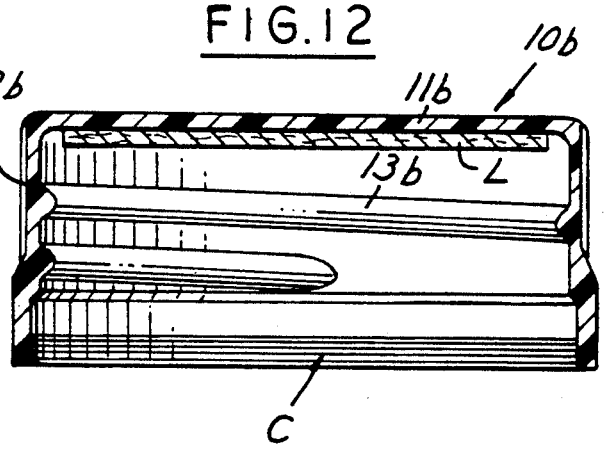
FIG. 12 is a vertical sectional view of a modified form of closure.
Figure 13:
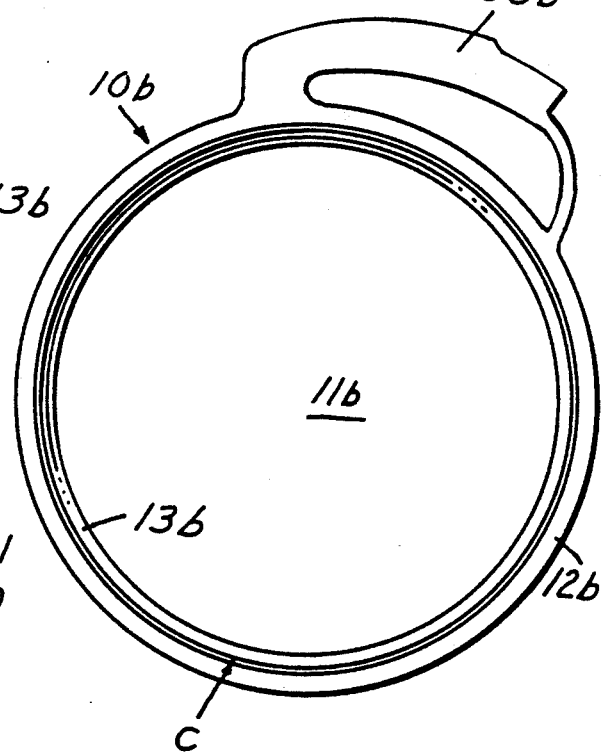
FIG. 13 is a bottom plan view of the closure.

In the modified form of the invention shown in FIGS. 12–14, the closure 10*b* comprises a base wall 11*b* and a peripheral skirt 12*b* with threads 13 on the inner surface of the peripheral skirt, as in the previous form of the invention. The closure 12*b* further includes a resilient liner L on the inner surface of the base wall 11*b* that forms a primary seal when the closure is threaded on the container. In this form, instead of having the flexible fins as in the previous form of the invention, the closure comprises a cylindrical surface C on the lower end of the peripheral skirt 12*b* which has a diameter slightly less than the diameter of the bead 20 on the container such that when the closure is applied to the container the cylindrical surface C has an interference fit with the bead 20 on the container, thereby opposing retrograde movement of the closure in the removal direction and at the same time providing an annular seal to inhibit flow of liquid out of the container when the container is tilted.

In the form shown in FIGS. 12–14, the cylindrical surface C is formed by a plurality of closely spaced annular ridges or serrations 40 separated by fine grooves 41 in alternating fashion. The axial extent of the cylindrical surface C is such that the interference fit exists when the closure is fully applied to the container as well as when the closure is rotated in a retrograde fashion to the extent that the seal between the inner surface of the closure, or any liner L thereon, is broken, even though the closure has not been rotated sufficiently to disengage the tab 30*b* from the obstruction 23 on the container.

Figure 15:
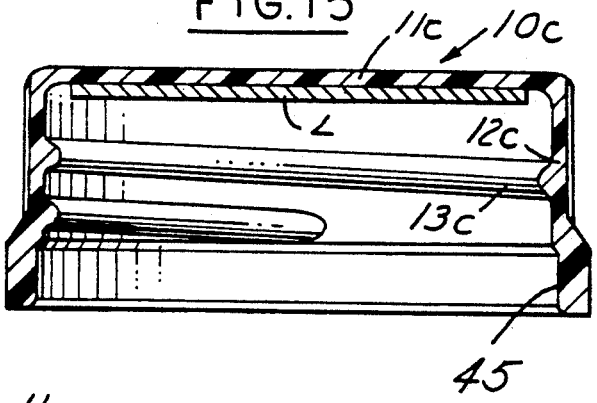
FIG. 15 is a vertical sectional view of a modified form of closure.
Figure 16:
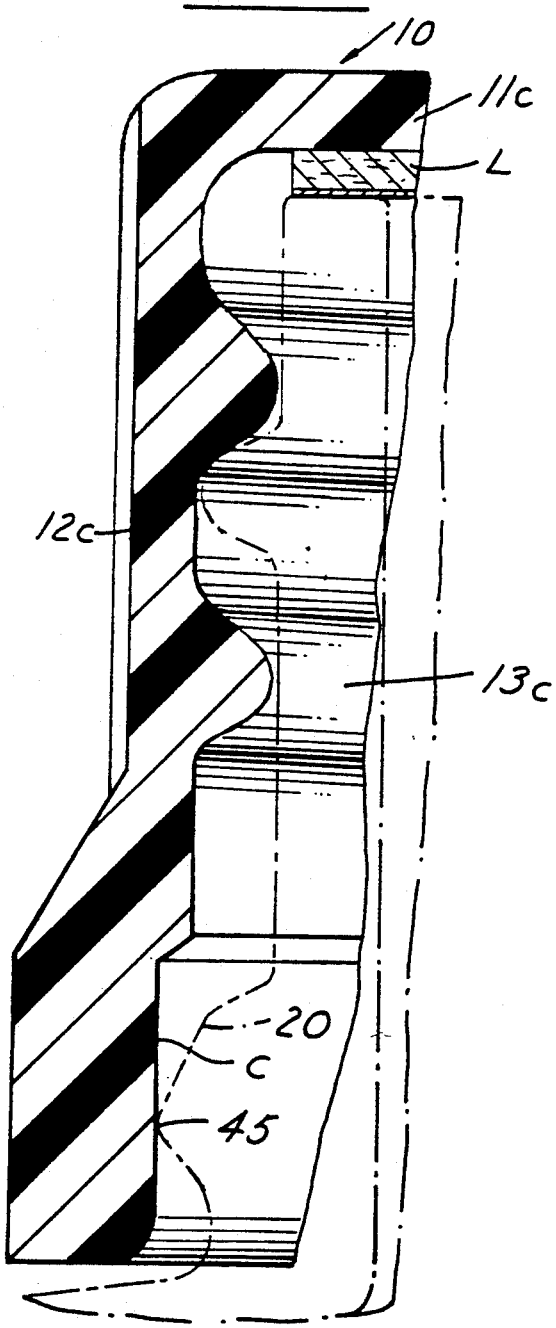
FIG. 16 is a fragmentary sectional view on a greatly enlarged scale of the closure shown in FIG. 15.
Figure 17:
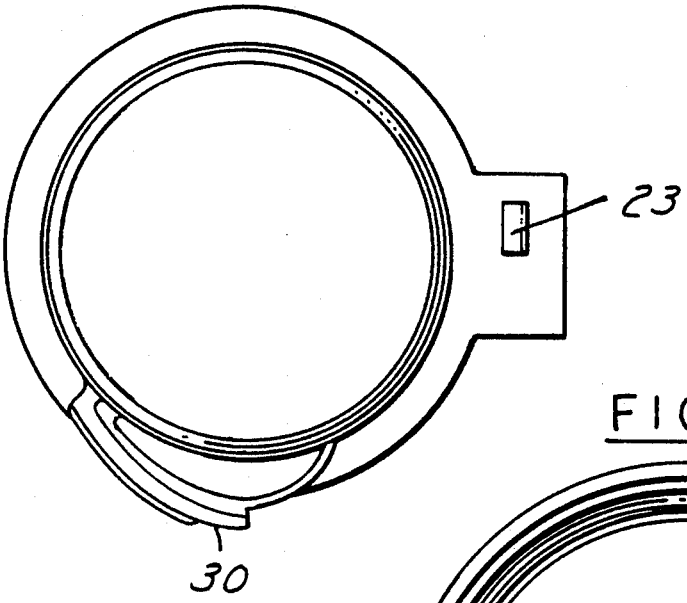
FIG. 17 is a plan view of the closures applied to a container.

In the form shown in FIGS. 15 and 16, the closure 10*c* comprises cylindrical surface C′ comprises a smooth cylindrical surface 45. In all other respects, the closure 12*c* is constructed like the closure 12*b* shown in FIGS. 12–14.

Thus, in the forms of the invention shown in FIGS. 12–16, the closure provides a secondary seal wherein a bead 20 on the container finish is positioned below the container threads and being larger in diameter than the threads; and the closure 10*b*, 10*c* has internal threads to engage threads 13*a* on the container and a lower portion C below the threads 13*a* which is larger in diameter then the container threads but smaller in diameter than the container bead 20.

The closure 12*b* further includes a resilient liner L on the inner surface of the base wall 11*b* that forms a primary seal when the closure is threaded on the container.

Figures 20, 21:
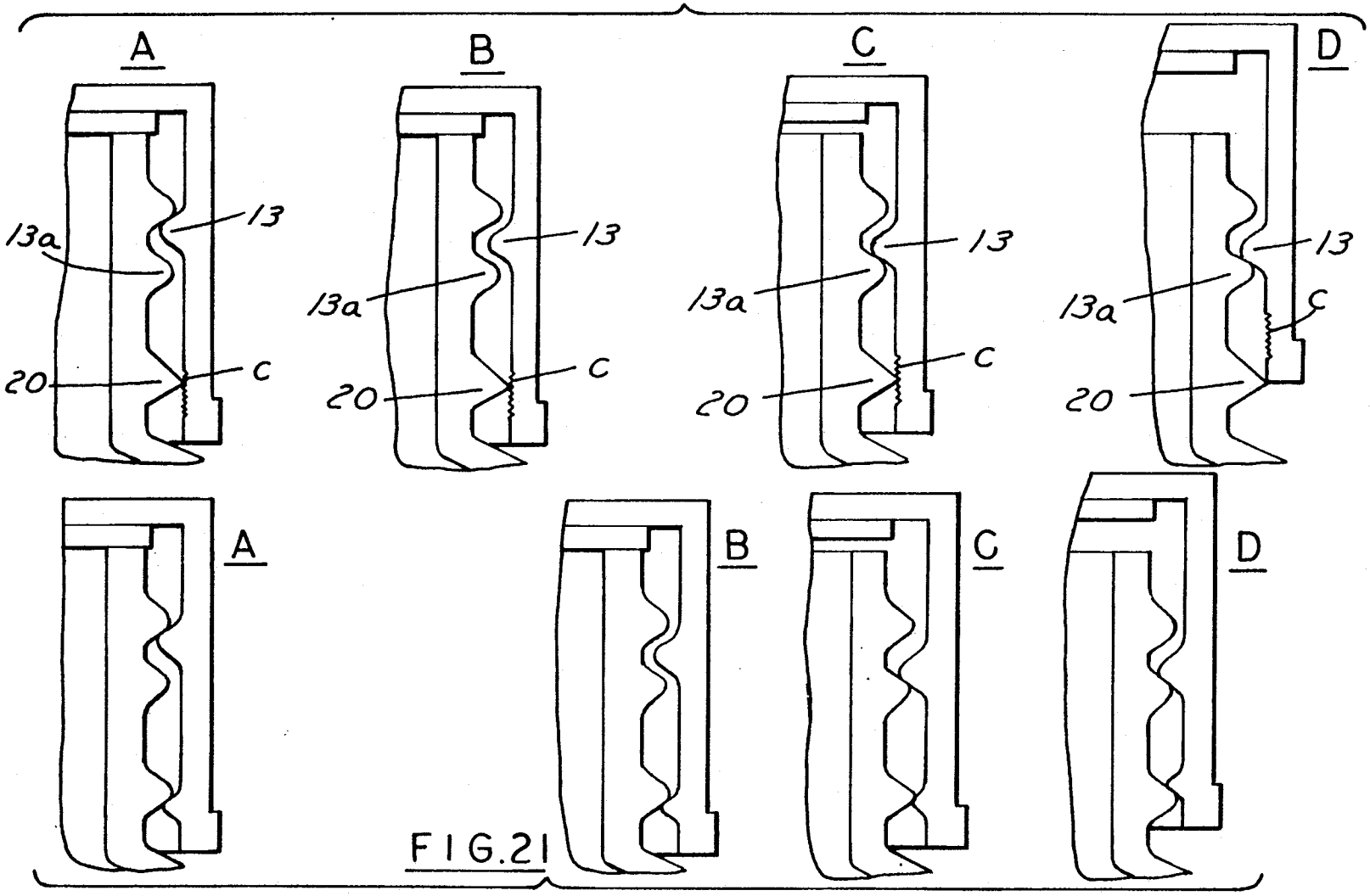
FIGS. 20 A,B,C, and D are schematic views of the manner in which the closure embodying the invention functions.
FIGS. 21 A,B,C, and D are schematic views of the manner in which a prior art closure functions.

Thus referring to FIGS. 20A,B,C,D, which are schematic views of the operation of the closures shown in FIGS. 12–16, when the child resistant closure is applied to the container, due to dimensional variations, the tab 30 on the closure may be positioned, for example, about 90° from the tab 23 on the container.

A seal exists in two locations, as shown in FIG. 20A (1) at the top of the finish where a liner L in the closure contacts the top of the finish and (2) an interference fit between the apex 20 of the container finish and the interior cylindrical surface of the closure. When the closure is fully applied, the thread engagement between the closure and container is such that the lower side of the container threads will be in contact with the upper side of the closure threads, and will keep the liner L in contact with the sealing surface of the finish. As the closure is rotated in a retrograde direction of removal, the threads on the closure and container will disengage from each other, and the liner will no longer be forcefully held in contact with the sealing surface on top of the container finish as shown in FIG. 20C. However, the package will not leak because the secondary seal provided by the interference fit between the apex on the finish bead and the surface C on interior of the closure skirt will remain in the sealing position. Further, rotation of the closure in the direction of removal will cause the under side of the closure thread to contact the upper side of the container thread (FIG. 20C) and cause the closure to move axially upward with respect to the container finish. Continued rotation in the removal direction will move the closure upward until the apex of the container bead is below the skirt of the closure and the secondary seal will now be opened FIG. 20D. Finally, continued rotation will result in total disengagement between the closure and container threads and the closure being removed from the package.

A relationship exists between the axial position of a closure on a finish and the number of degrees of rotation of the closure on the container from any arbitrary reference point. For example, in an ordinary screw type lined closure applied to an appropriate finish, if one were to remove the liner, it would be evident that the closure could be turned onto the container further, that is the relative axial position of the closure with respect to the inside top of the closure would change and the number of degrees of rotation in applying the closure would increase. In much the same way, dimensional tolerances of the container finish and closure will affect the relative axial position of the closure and the number of degrees of rotation required to seat the closure on the finish.

The present invention is not affected by these dimensional tolerances as the length of the closure skirt, in the area contacted by the apex of the bottle bead, can be made sufficient length of afford engagement over a wide range of tolerances.

In the prior art U.S. Pat. No. 3,971,478 which utilized a single seal between the closure and container, the vertical height and dimensional tolerances of the closure and container finish are critical. That is the relative vertical distance between the bead on the container finish and the internal bead on the closure is essential to insuring that the liner remain in contact with the container finish during retrograde. In other words, the total of all the dimensional tolerances affecting the vertical relationship between the top of the container finish and the bead on the container; plus all of the dimensional tolerances affecting the distance from the liner, where it contacts the container finish, to the bead on the closure where it contacts the finish bead, must be equal to or less than the distance from the top of the container thread to the bottom of the closure thread when the closure is fully tightened on the container finish. (FIG. 21A)

This may be more readily understood by reference to FIGS. 21A,B,C, and D which are schematic views similar to FIGS. 20A,B,C, and D.

In this prior patent, it is essential to have a zone equal to or less than the number of degrees of rotation from a fully tightened position of the closure on the container to the position where the tab 30 on the closure contacts the abutment 23 on the container. If this zone is less, as the closure is turned in retrograde, the bottom surface of the closure thread will contact the top surface of the container thread and drivingly force the closure upward so that the liner is moved out of contact with the container sealing surface, before the tab on the closure contacts the abutment on the container as shown in FIG. 21C.

The aforementioned inventions are especially applicable for use with screw type child resistant closures where an abutment on or in the proximity of the container finish limits the unscrewing of the closure by abutting a projection on the closure. Closures having tabs, and squeeze and turn type closures are typical examples.

Figure 18:
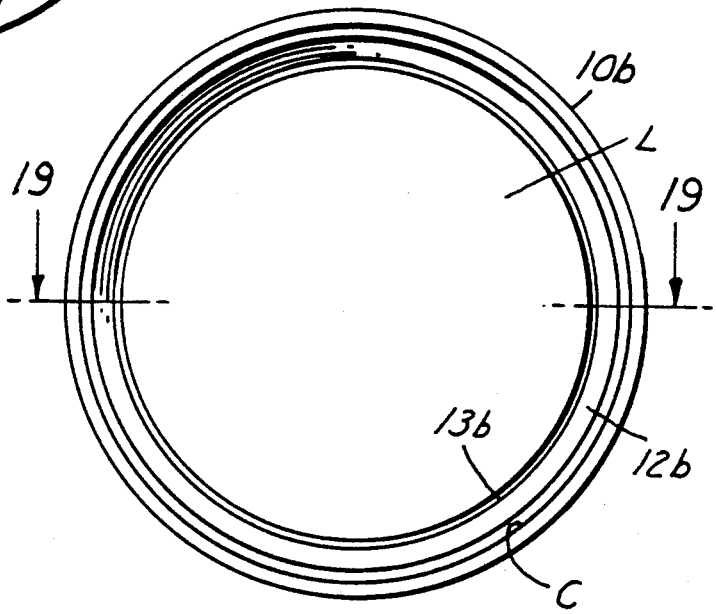
FIG. 18 is a bottom plan view of a modified form of closure without a child resistance feature.
Figure 19:
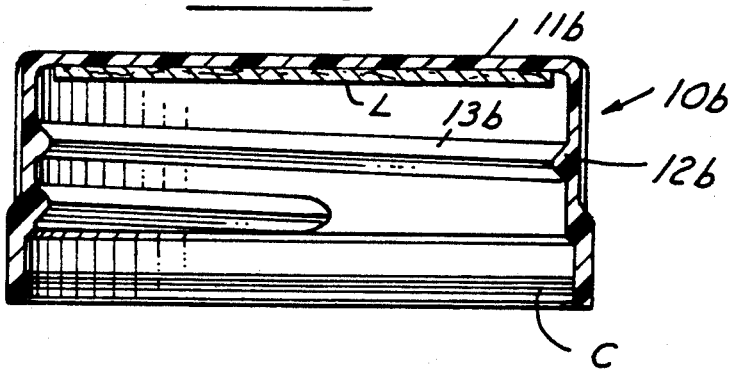
FIG. 19 is a sectional view taken along the line 19—19 in FIG. 18.

Referring to FIGS. 18 and 19, the invention is shown as applied to a threaded closure 10*d* which is identical to that shown in FIGS. 12–14 except the child resistant tab 30 has been omitted. In such a closure when the closure is turned in a counterclockwise manner on a container having a bead 20, the primary seal may be lost but the cylindrical surface C will maintain a secondary seal until the threads engage in a retracting manner.

Such closure container systems have engaging screw threads on the container finish and inside the closure, and a liner or linerless seal that contacts the top of the container finish or the immediate proximity thereof. These seals are well known and are widely used in commerce. However, external forces acting upon the closure can cause the closure to "back off"; either unintentionally or intentionally. These forces could be vibration, top load, impact, etc., a person intentionally rotating the closure in the counterclockwise direction or a person not fully reapplying the closure to engage the sealing mechanism. The closure shown in FIGS. 18 and 19 inhibits a tendency to rotate due to such forces.

The closure may be molded of thermoplastic material, preferably polypropylene or polyethylene. The container is manufactured of any suitable material including plastic, glass or metal.

While a lined closure is shown, this invention is not limited to lined closures and the concept could be utilized within any number of different linerless features.

Figure 8:
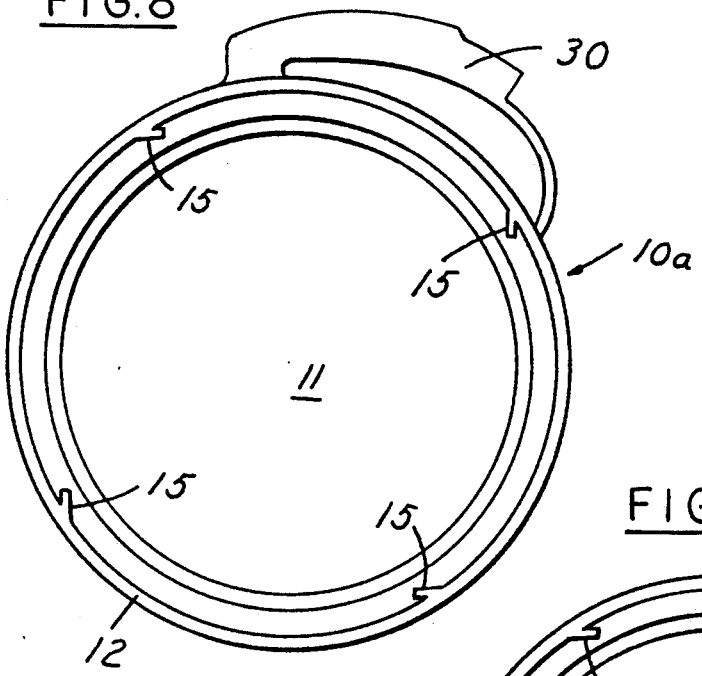
FIG. 8 is a bottom plan view of a modified form of closure.
Figure 10:
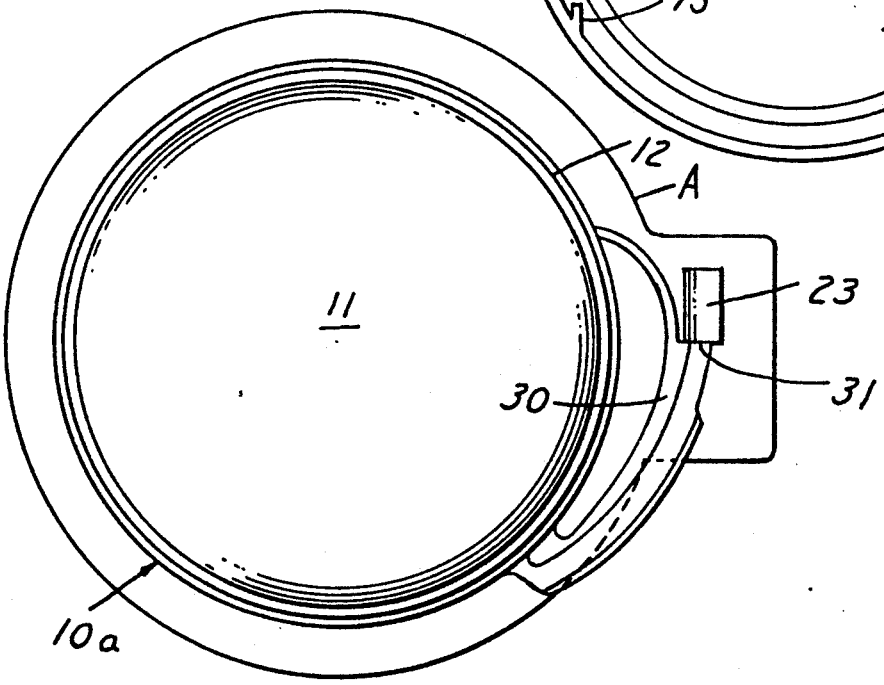
FIG. 10 is a plan view of a further modified form of closure.

In the form shown in FIGS. 8 and 10, the closure 10*a* is identical except that the tab 30 is of the type shown in U.S. Pat. No. 3,989,152. The tab 30 is connected at its ends to the skirt 12 and includes a projection 31 which engages the abutment 23 on the container unless the tab 30 is depressed.

Figure 9:
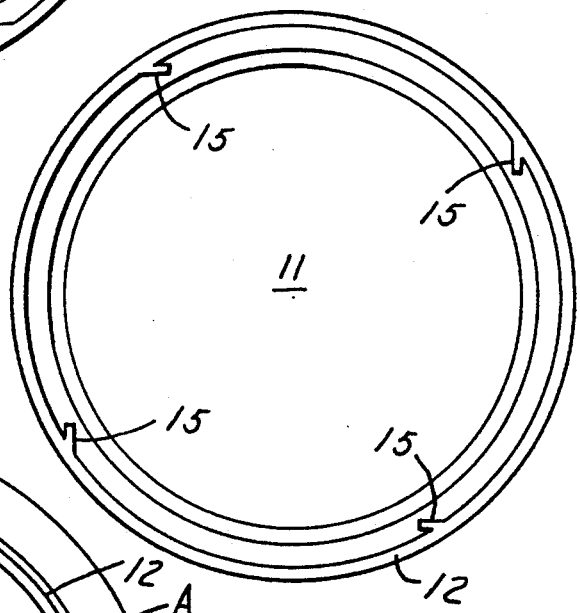
FIG. 9 is a bottom plan view of the closure shown in FIG. 8 as applied to a container.

In the form shown in FIG. 9, the closure 10*b* is not provided with a tab.

Figure 11:
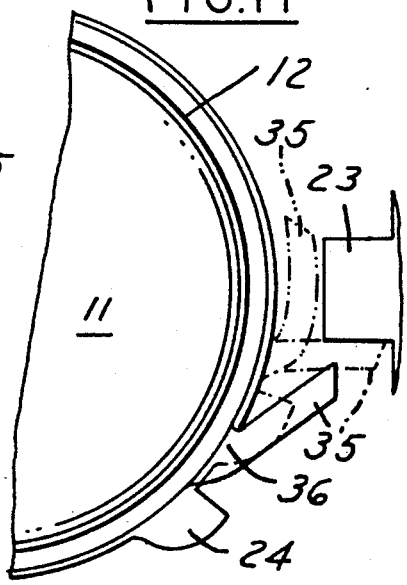
FIG. 11 is a fragmentary plan view of another modified form of closure and container.
Figure 4:
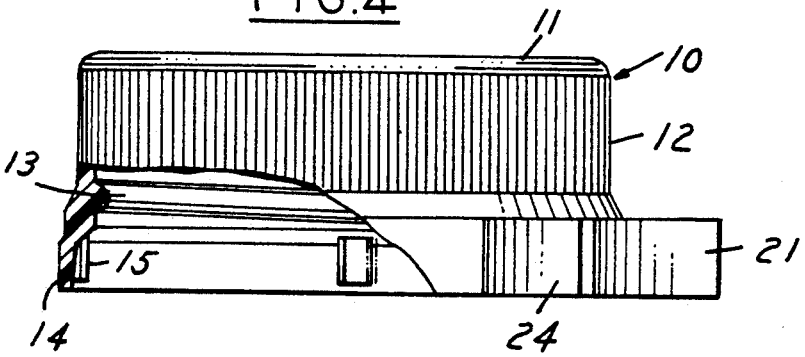
FIG. 4 is a part sectional elevational view of the closure.
Figure 5:
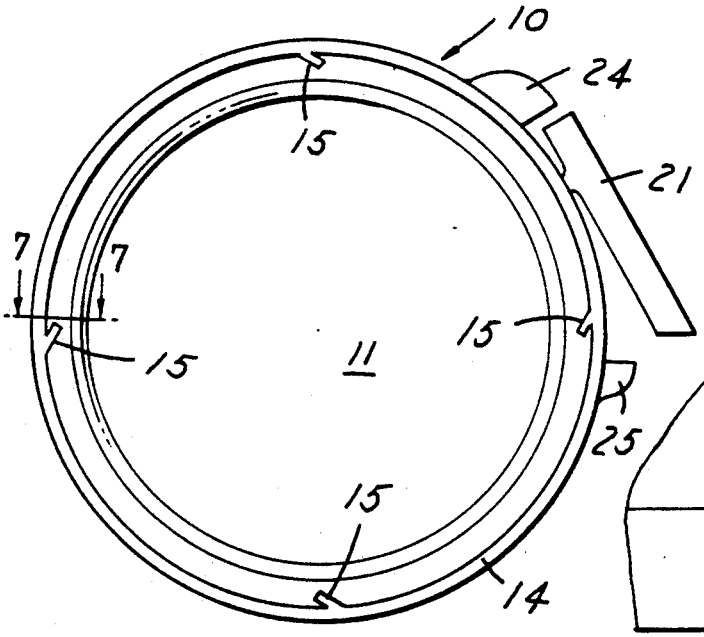
FIG. 5 is a bottom plan view of the closure.
Figure 6:
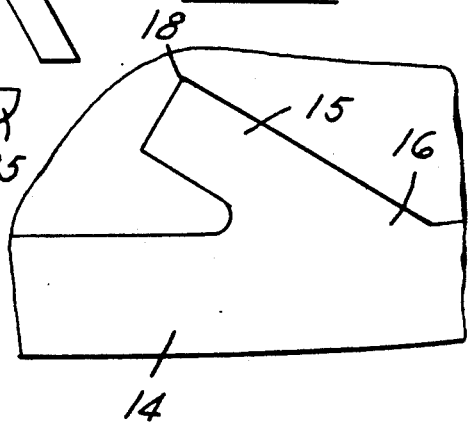
FIG. 6 is a fragmentary view of an enlarged scale of a portion of the closure.
Figure 7:
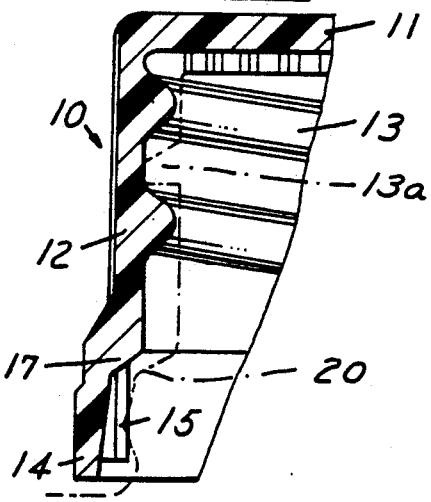
FIG. 7 is a fragmentary sectional view on enlarged scale taken along the line 7—7 in FIG. 5.
Figure 7A:
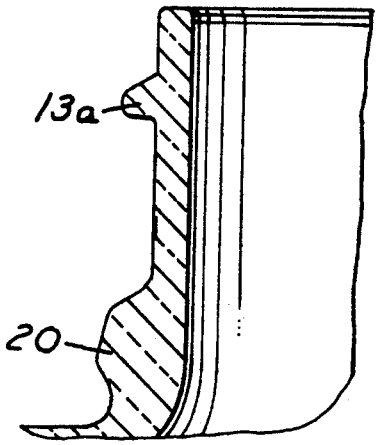
FIG. 7A is a fragmentary sectional view of the finish of a container to which the closure is applied.

In the form of the invention shown in FIG. 11, the closure comprises a tab 35 which extends circumferentially in a counterclockwise direction as viewed from the top so that the tab 35 flexes at a hinge 36 with respect to the closure when the closure is rotated past the projection 23 on the container. The closure is thus prevented from being removed by engagement of the free end of tab 35 with projection 23 on the container. In all other respects, the closure is like that shown in FIGS. 1–7.

Current one piece child resistant closures require a substantial amount of force to depress a tab while rotating past an abutment on the containers finish. The present design is user friendly in that a much less force is necessary to depress the tab 35 when the tab 35 is depressed prior to the point where it would come into contact with the abutment 23. If the tab 35 is not depressed while the closure is being rotated in a counterclockwise or unthreading direction, the tab 35 will contact the abutment 23 and be deflected or bent outward and become wedged between the abutment 23 on the finish and the projection 24 on the closure.

The distance from the center line of the finish to the inner side of the abutment is less than the distance from the center line of the closure to tip of the projection. During application of the closure onto the finish in a normal manner for a screw cap 20, namely, in a clockwise direction as viewed from the top, the tab 35 will contact the inner edge of the abutment 23 and be deflected inward until the tab 35 is completely past the abutment 23. At that time, the tab 35 will again spring outward. When the closure 10 is fully applied and tightened, the tab 35 will be spaced some distance from the abutment 23 in the clockwise direction and in the extended position.

When the closure is being removed by unscrewing in the opposite direction, the tab 35 will contact the abutment 23 and be deflected outward from its normal position until it becomes wedged against the abutment 23 on the finish and the projection 24 on the closure. Additional force in an effort to unscrew the closure will cause a type of shearing action on the tab but the closure 10 can not be unscrewed.

In practice, instructions may be printed on top of the closure such as "To Open Push Tab In While Turning". Following these directions, pushing the tab 35 in causes the tip of the tab 35 to rotate past the inner surface of the abutment 23 as the closure is unscrewed. Once the tab 35 has moved past the abutment, the closure can continue to be unscrewed, without holding the tab 35 in until it is fully removed from the finish.

It can thus be seen that there has been provided a child resistant closure which is adapted to be used with a container to provide a child resistant package and which comprises a closure having a base wall and a peripheral skirt with internal threads adapted to engage complementary threads on the container. The closure is provided with a plurality of circumferentially spaced flexible fins which frictionally engage the apex only of an annular bead on the container to provide resistance to closure back off in order to resist unthreading of the closure from the container. The closure is provided with a tab which is engageable with a projection on the container to prevent unthreading of the closure except when the tab is depressed. In another form, a cylindrical surface on the skirt frictionally engages solely the apex of the annular bead on the container. The cylindrical surface may be a continuous surface or a series of closely spaced annular serrations and alternating fine grooves. The closure may also be used without a tab to provide a secondary seal on a conventional threaded closure.

I claim:

1. A child resistant package comprising a container having external threads and an annular bead on the container spaced below the threads, said bead having an apex, a plastic closure having a base wall and a peripheral skirt with complementary internal threads adapted to engage said threads on the container, said closure having means on said skirt below said threads adapted to engage the apex of the bead on the container to provide resistance to unthreading of the closure relative to the container, a deflectable tab on said closure having one end adapted to extend into the path of an abutment on the container such that said one end of the tab can be deflected past the abutment when the closure is applied to the container but said one end will engage the abutment when the closure is grasped and rotated to remove the closure unless the tab is manually depressed, said tab being hinged intermediate its ends to the skirt of the closure and extending at an angle to the circumference of the closure so that the outer end of the tab will engage the abutment on the container.

2. The child resistant package set forth in claim 1 wherein said closure includes a projection extending radially outwardly therefrom adjacent the opposite end of the tab such that when the tab engages the abutment on the container, the tab becomes wedged between the abutment on the container and the projection on the closure.

3. A package comprising a plastic container having a finish with external threads and having an annular bead on the container spaced below the threads, said bead having an apex, a plastic closure having a base wall and a peripheral skirt with complementary internal threads adapted to engage said threads on the container, a deflectable portion on said closure and an abutment on the container, said portion being adapted to extend into the path of the abutment on the container such that the deflectable portion can be deflected past the abutment when the closure is applied to the container but will engage the abutment when the closure is grasped and rotated to remove the closure unless the deflectable portion is manually depressed, said skirt of said closure having a cylindrical surface comprised of a plurality of closely spaced annular serrations and fine grooves separating said serrations in alternating fashion, said serrations and associated fine grooves having an axial extent such that an interference fit will exist over a wide range of tolerances of the container finish and closure with the apex of the bead when the closure is fully applied as well as when the closure is rotated in retrograde fashion to the extent that any other seal between the closure and container is broken, even through the closure has not been rotated sufficiently to disengage the deflectable portion from the abutment on the container.

4. The package set forth in claim 3 wherein said tab is hinged intermediate its ends to the skirt of the closure and extends at an angle to the circumference of the closure so that the outer end of the tab will engage a projection on the container.

5. The package set forth in claim 3 wherein said closure includes a projection extending radially outwardly therefrom adjacent the opposite end of the tab such that when the tab engages the abutment on the container, the tab becomes wedged between the abutment on the container and the abutment on the closure.

6. The package set forth in claim 3 where said tab is hinged to the closure at one end and extends circumferentially in a direction opposite to the direction in which the closure is rotated to apply the closure.

* * * * *